United States Patent [19]

Burnett et al.

[11] Patent Number: 5,035,627

[45] Date of Patent: Jul. 30, 1991

[54] ELECTRONICS INTERCONNECTION MECHANISM

[75] Inventors: Carl M. Burnett; Karl H. Wester, both of Melbourne, Fla.

[73] Assignee: Storage Technology Corporation, Louisville, Colo.

[21] Appl. No.: 565,051

[22] Filed: Aug. 9, 1990

[51] Int. Cl.[5] ..... H01R 13/629

[52] U.S. Cl. ..... 439/64; 439/152; 439/377

[58] Field of Search ..... 439/296, 297, 377, 378, 439/76, 374, 64, 152; 361/413

[56] References Cited

U.S. PATENT DOCUMENTS

| | | | |
|---|---|---|---|
| 4,230,986 | 10/1980 | Deaver et al. | 439/64 |
| 4,935,847 | 6/1990 | Welsh | 439/64 |
| 4,941,841 | 7/1990 | Darden et al. | 439/296 |
| 4,979,075 | 12/1990 | Murphy | 361/413 |

*Primary Examiner*—Gary F. Paumen

*Attorney, Agent, or Firm*—Dorr, Carson, Sloan & Peterson

[57] ABSTRACT

An apparatus is disclosed to provide electrical interconnections between a first electronic device (such as printer) having a plurality of external electrical connectors, and a second electronic device (such as an electronics PCB package) having an electrical connector (such as a mass pin connector) mounted on its housing. The apparatus has an interconnection assembly with a set of electrical connectors adapted to mate with the electrical connectors of the printer, and a mass pin connector along its bottom edge to mate with the corresponding mass pin connector on the PCB package. A predefined set of electrical connections exist between the printer connectors and the mass pin connector on the interconnection assembly. A bracket assembly attached to the printer housing has two tracks that receive the interconnection assembly and permit it to slide along a predetermined axis with respect to the printer housing and the PCB package to permit the mass pin connector of the interconnection assembly to mate with the mass pin connector of the PCB package. An opening through the bracket assembly permits the print cable connectors to pass through the bracket assembly and be connected to the electrical connectors on the face of the interconnection assembly.

7 Claims, 2 Drawing Sheets

ELECTRONICS INTERCONNECTION MECHANISM

BACKGROUND OF THE INVENTION

1. Field of the Invention

The present invent relates generally to the field of electrical connectors. More specifically, the present invention discloses a device to minimize the risk of misalignment and damage to a mass pin connector by providing alignment guides as the halves of the connector are drawn together.

2. Statement of the Problem

In many computer systems, it is advantageous to be able to have the customer replace certain electronics packages or subsystems without the need for on-site service by the manufacturer's personnel. For example, some types of computer printers have an electronic control unit (or PCB package) that has its own housing and is detachable from the remainder of the printer. Replacement of the electronics PCB package presents a problem due to the large number of cables and connectors that need to be correctly installed between the PCB package and the printer. One solution is to use a single mass pin connector which eliminates the need to handle multiple cable assemblies. Unfortunately, this approach creates a new problem in that pins of a mass pin connector can be easily damaged if the halves of the connector are not properly aligned when drawn together.

3. Solution to the Problem

The present invention overcomes this problem by providing a interconnection assembly that consolidates the multiple cable assemblies from the printer into a single mass pin connector, and also provides a series of guides to help insure proper alignment with the other half of the mass pin connector mounted on the PCB package.

SUMMARY OF THE INVENTION

This invention provides an electronics interconnection mechanism between a first electronic device (such as a printer) having a plurality of external electrical connectors, and a second electronic device (such as an electronics PCB package) having an electrical connector (such as a mass pin connector) mounted on its housing. The mechanism has an interconnection assembly with a set of electrical connectors adapted to mate with the printer cable connectors, and a mass pin connector along its bottom edge to mate with the corresponding mass pin connector on the top of the PCB package. A predefined set of electrical connections exist between these electrical connectors and the mass pin connector on the interconnection assembly. A bracket assembly attached to the printer housing has two tracks that receive the interconnection assembly and permit it to slide along a predetermined axis with respect to the printer housing and the PCB package to permit the mass pin connector of the interconnection assembly to mate with the mass pin connector of the PCB package. An opening through the bracket assembly permits the printer cable connectors to pass through the bracket assembly and be connected to the electrical connectors on the face of the interconnection assembly.

A primary object of the present invention is to provide simplified electrical interconnection between two electronic devices.

Another object of the present invention is to provide an apparatus to guide connection of the two halves of a mass pin connector to insure proper alignment and minimize the risk of damage to the pins.

These and other advantages, features, and objects of the present invention will be more readily understood in view of the following detailed description and the drawings.

BRIEF DESCRIPTION OF THE DRAWINGS

The present inVention can be more readily understood in conjunction with the accompanying drawings, in which.

DETAILED DESCRIPTION OF THE INVENTION

Figure 1:
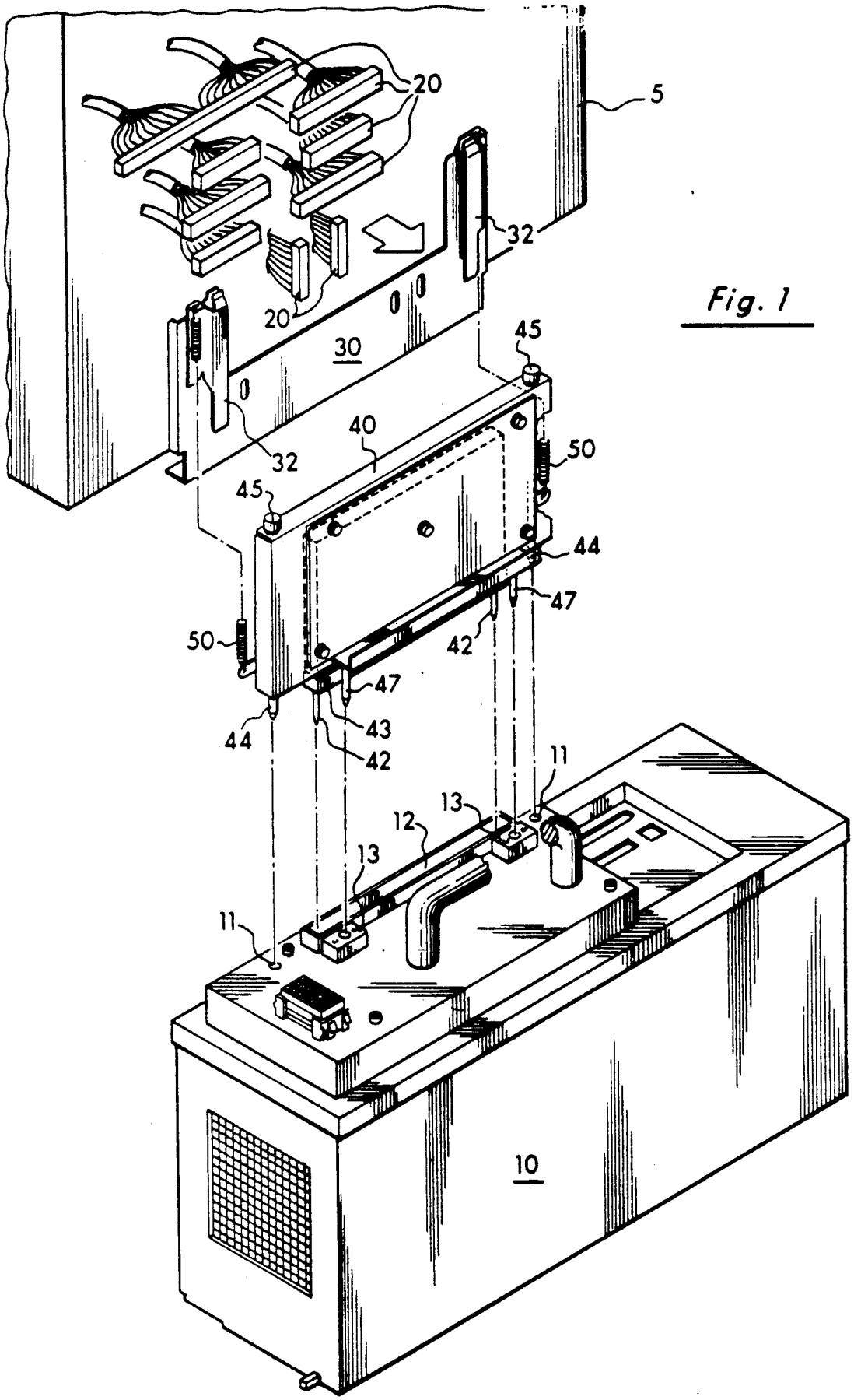
FIG. 1 is an exploded perspective view showing the major components of the present invention.
Figure 2:
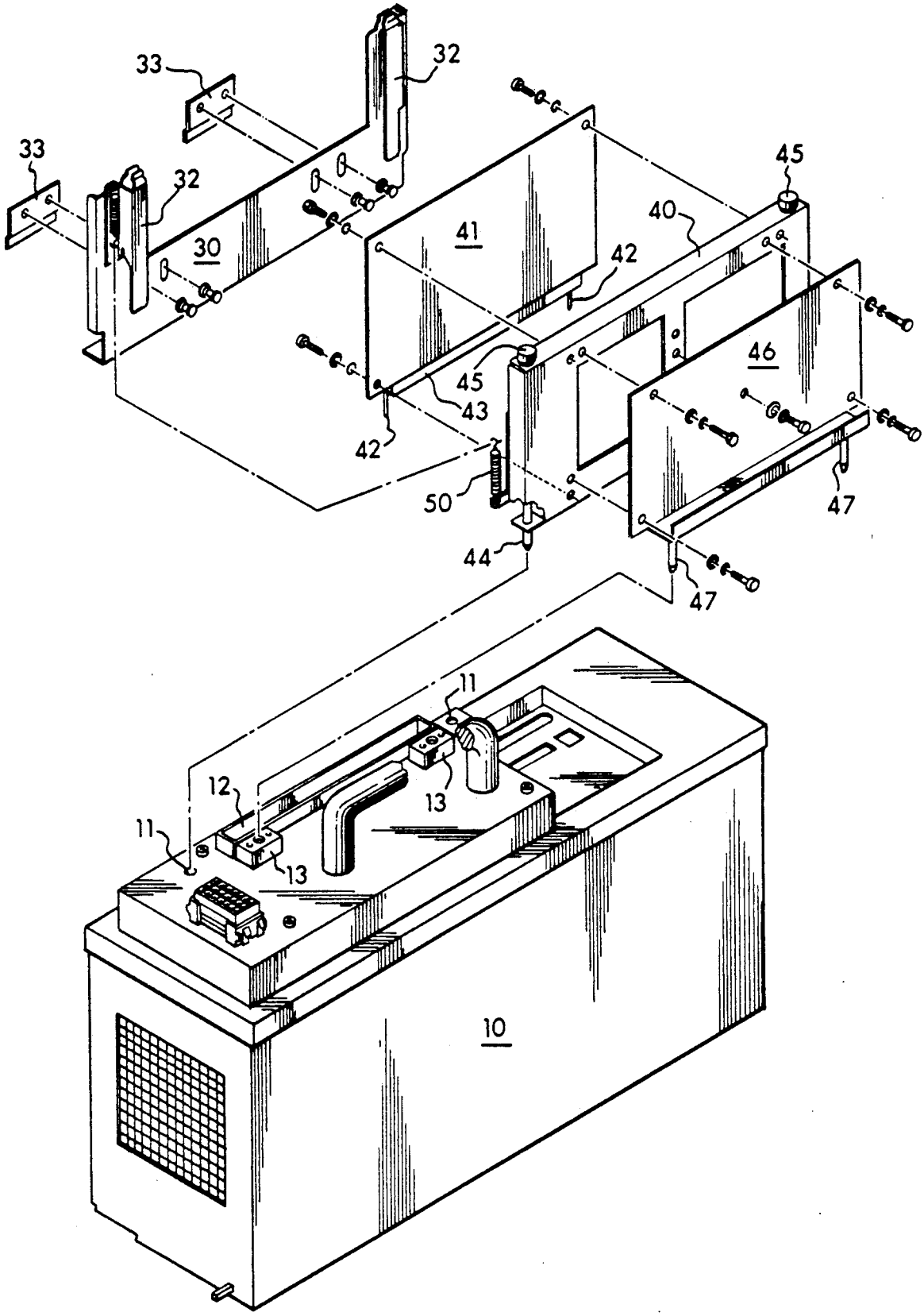
FIG. 2 is another exploded perspective view showing additional detail of the interconnection assembly.

Turning to FIG. 1, an exploded perspective view of the interconnection mechanism is provided. FIG. 2 shows additional detail. The purpose of the present invention is to provide electrical connections between a first electronic device (such as a printer) having a number of external electrical connectors 20, and a second electronic device 10 (such as a PCB package) having at least one mass pin connector 12.

The first major component of the present invention is a mounting bracket assembly 30 removably attached by means of series of brackets 33 to the printer housing 5 adjacent to the electrical connectors 20. An opening through the bracket assembly permits these print cable connectors 20 to pass through the bracket assembly toward a corresponding set of connectors mounted on the printed circuit board 41 of the interconnection assembly discussed below. In addition, the bracket assembly has two opposing tracks 32 located on either side of this opening. In the preferred embodiment, these tracks 32 have a C-shaped cross-section and are mounted in a vertical orientation, substantially parallel to one another. The lower ends of both tracks 32 are open to permit the interconnection assembly to enter and engage the tracks 32 and slide for a limited distance in a vertical plane.

The other major component of the present invention is the interconnection assembly comprised of a vertical frame 40 to which are attached a printed circuit board 41 and a supporting plate 46. A number of electrical connectors are mounted on the side of the printed circuit board 4 facing the bracket assembly 30. These connectors are adapted to mate with the print cable connectors 20.

The bottom edge of the interconnection assembly has a mass pin connector 43 adapted to mate with a corresponding mass pin connector 12 located on the top of the PCB package 10. An appropriate set of electrical connections are provided by the interconnection assembly between the mass pin connector 43 and the print cable connectors 20.

The bottom edge of the interconnection assembly also has a number of alignment pins 42 and 47 extending downward from its bottom edge. These pins are received by corresponding holes 13 in the top of the housing and/or mass pin connector 12 of the PCB package 10, and thereby assist in maintaining proper vertical alignment between the interconnection assembly and the PCB package 10 as the halves of the mass pin connector 12 and 43 are fitted together, as described below.

In the preferred embodiment, a pair of thumb screws 45 extend vertically downward through the interconnection assembly. The lower ends 44 of these thumb screws can be removably secured to, or detached from corresponding threaded holes 11 in the top of the PCB package by manually rotating the upper ends of the thumb screws 45. These thumb screws 45 provided a number of advantages in: (1) maintaining proper vertical alignment between the interconnection assembly and the PCB package 10 as the mass pin connectors 12 and 43 are drawn together; (2) helping to prevent damage to the mass pin connectors by limiting the speed with which the connectors are drawn together; and (3) securing the mass pin connectors in place after installation is completed.

The lateral edges of the interconnection assembly are generally vertical in orientation and have a finite width sufficient to permit the interconnection assembly to be received between the opposing tracks 32 of the bracket assembly 30. The tracks 32 allow the interconnection assembly to slide for a limited distance in a vertical plane with respect to both the printer and PCB package.

A number of springs 50 extend between the bracket assembly and the interconnection assembly. These springs 50 provide an upward biasing force that tends to keep the interconnection assembly from falling out of the lower ends of the tracks 32 of the bracket assembly 30.

The following sequence of steps can be used in a typical installation of the present invention:

(1) Mount the bracket assembly 30 to the housing of the printer.

(2) Attach the printer cable connectors 20 to the corresponding connectors on the face of the interconnection assembly.

(3) Insert the interconnection assembly between the tracks 32 of the bracket assembly 30, connect springs 50 between the bracket assembly and interconnection assembly to provide partial restraint of the vertical movement of the interconnection assembly as it slides along between the tracks 32.

(4) Move the interconnection assembly vertically downward to cause the guide pins 42 and 47 to engage with corresponding holes in the top of the housing of the PCB package to insure proper vertical alignment of the mass pin connectors 43 and 12.

(5) Tighten thumbscrews 45 to complete installation by drawing the mass pin connectors 43 and 12 together.

The above disclosure sets forth a number of embodiments of the present invention. Other arrangements or embodiments, not precisely set forth, could be practiced under the teachings of the present invention and as set forth in the following claims.

I claim:

1. An apparatus adapted to provide electrical interconnections between a first electronic device having a housing and plurality of external electrical connectors, and a second electronic device having a housing an electrical connector mounted on said housing, said apparatus comprising:

an interconnection assembly having:

(a) an edge;

(b) a plurality of first electrical connectors adapted to mate with a corresponding number of said electrical connectors of said first device;

(c) a second electrical connector extending along a portion of said edge adapted to mate with said electrical connector of said second device; and (d) a predefined set of electrical connections between said first electrical connectors and said second electrical connector;

a bracket assembly attached to said housing of said first device having a plurality of tracks adapted to receive said interconnection assembly and permit movement of said interconnection assembly along a predetermined axis with respect to said first housing to permit said second connector of said interconnection assembly to mate with said electrical connector of said second device, and further having an opening adapted to permit said electrical connectors of said first device to pass through said bracket assembly and be connected to said first connectors of said interconnection assembly; and spring means connecting said interconnection assembly with said bracket assembly, adapted to provide a biasing force tending to separate said second connector of said interconnection assembly from said connector of said second device.

2. The apparatus of claim 1, wherein said interconnection assembly further comprises a number of guide pins extending from said interconnection assembly in a direction parallel to said axis toward said second device; and wherein the housing of said second device further comprises a corresponding number of holes adapted to receive said guide pins and insure proper alignment as said second connector of said interconnection assembly mates with said connector of said second device.

3. The apparatus of claim 1, wherein said interconnection assembly further comprises a number of screws extending from said interconnection assembly in a direction parallel to said axis toward said second device; and wherein the housing of said second device further comprises a corresponding number of threaded holes adapted to receive said screws and thereby permit said second connector of said interconnection assembly to be properly aligned and mated with said connector of said second device as said screws are tightened.

4. The apparatus of claim 1, wherein said interconnection assembly further comprises two lateral edges substantially parallel to said axis, and wherein said bracket assembly comprises two tracks substantially parallel to said axis adapted to receive said lateral edges of said interconnection assembly and permit said interconnection assembly to slide along said axis.

5. An apparatus adapted to provide electrical interconnections between a first electronic device having a housing and plurality of external electrical connectors, and a second electronic device having a housing, an electrical connector mounted on said housing, and a number of alignment holes; said apparatus comprising:

an interconnection assembly having:

(a) two substantially parallel lateral edges and a bottom edge;

(b) a substantially planar surface to which are attached a plurality of first electrical connectors adapted to mate with a corresponding number of said electrical connectors of said first device;

(c) a second electrical connector extending along a portion of said bottom edge adapted to mate with said electrical connector of said second device; and (d) a predefined set of electrical connections between said first electrical connectors and said second electrical connector;

a bracket assembly adapted to attach to said housing of said first device, having:

(a) two substantially parallel tracks adapted to receive said lateral edges of said interconnection assembly and permit movement of said interconnection assembly along a predetermined axis with respect to said first housing to permit said second connector of said interconnection assembly to mate with said electrical connector of said second device; and (b) a defined opening between said parallel tracks adapted to permit said electrical connectors of said first device to pass through said bracket assembly and be connected to said first connectors of said interconnection assembly;

a number of elongated alignment members extending from said interconnection assembly in a direction parallel to said axis toward said second device adapted to be received by said alignment holes of said second device to insure proper alignment as said second connector of said interconnection assembly mates with said connector of said second device; and spring means connecting said interconnection assembly with said bracket assembly, adapted to provide a biasing force tending to separate said second connector of said interconnection assembly from said connector of said second device.

6. The apparatus of claim 5, wherein a number of said alignment members comprise screws; and wherein a corresponding number of said alignment holes are threaded to receive said screws and thereby permit said second connector of said interconnection assembly to be properly aligned and mated with said connector of said second device as said screws are tightened.

7. An apparatus adapted to provide electrical interconnections between a first electronic device having a housing and plurality of external electrical connectors; and a second electronic device having a housing, an electrical connector mounted on said housing, and a number of threaded alignment holes; said apparatus comprising:

an interconnection assembly having:

(a) two substantially parallel lateral edges and a bottom edge;

(b) a substantially planar surface to which are attached a plurality of first electrical connectors adapted to mate with a corresponding number of said electrical connectors of said first device;

(c) a second electrical connector extending along a portion of said bottom edge adapted to mate with said electrical connector of said second device; and (d) a predefined set of electrical connections between said first electrical connectors and said second electrical connector;

a bracket assembly adapted to attach to said housing of said first device, having:

(a) two substantially parallel tracks adapted to receive said lateral edges of said interconnection assembly and permit said interconnection assembly to slide along a predetermined axis with respect to said first housing to permit said second connector of said interconnection assembly to mate with said electrical connector of said second device; and (b) a defined opening between said parallel tracks adapted to permit said electrical connectors of said first device to pass through said bracket assembly and be connected to said first connectors of said interconnection assembly;

a number of threaded alignment members rotatably mounted through a portion of said interconnection assembly in a direction parallel to said axis, adapted to be received by a corresponding number of said threaded alignment holes to insure proper alignment and to mate said second connector of said interconnection assembly with said connector of said second device as said threaded alignment members are tightened; and spring means connecting said interconnection assembly with said bracket assembly, adapted to provide a biasing force tending to separate said second connector of said interconnection assembly from said connector of said second device.

* * * * *